US009206613B2

(12) United States Patent
Walker

(10) Patent No.: US 9,206,613 B2
(45) Date of Patent: Dec. 8, 2015

(54) SIDING INSTALLATION TOOL

(71) Applicant: Lawrence Walker, Houston, TX (US)

(72) Inventor: Lawrence Walker, Houston, TX (US)

( * ) Notice: Subject to any disclaimer, the term of this patent is extended or adjusted under 35 U.S.C. 154(b) by 0 days.

(21) Appl. No.: 13/717,671

(22) Filed: Dec. 17, 2012

(65) Prior Publication Data

US 2015/0033571 A1 Feb. 5, 2015

(51) Int. Cl.
*E04F 21/18* (2006.01)

(52) U.S. Cl.
CPC ..... *E04F 21/1855* (2013.01)

(58) Field of Classification Search
CPC ..... E04F 21/18; E04F 21/1855
USPC ..... 33/464, 646, 647, 809
See application file for complete search history.

(56) References Cited

U.S. PATENT DOCUMENTS

| | | | | | |
|---|---|---|---|---|---|
| 316,338 | A * | 4/1885 | Davis | 33/646 |
| 377,178 | A * | 1/1888 | Traut | 33/647 |
| 418,754 | A * | 1/1890 | Schill | 33/646 |
| 693,054 | A * | 2/1902 | Nelson | 33/649 |
| 1,115,202 | A * | 10/1914 | Ingles | 33/646 |
| 3,490,152 | A * | 1/1970 | Printz | 33/649 |
| 6,434,853 | B2 * | 8/2002 | Pyburn | 33/647 |
| 6,663,084 | B1 * | 12/2003 | Butler | 254/100 |
| 6,705,021 | B2 * | 3/2004 | Tiel et al. | 33/647 |
| 6,836,969 | B1 * | 1/2005 | Bates | 33/42 |
| 8,656,603 | B1 * | 2/2014 | Rush | 33/647 |
| 2011/0018183 | A1 * | 1/2011 | Monteer | 269/55 |

* cited by examiner

*Primary Examiner* — R. A. Smith
(74) *Attorney, Agent, or Firm* — Darcell Walker

(57) ABSTRACT

An improved panel siding installation device enables a worker installing panel siding on a building structure such as a house to accurately and efficiently measure the distance between edges of adjacent siding panels. This distance is known as the "reveal distance" of the lap siding. In addition to accurately measuring the distance between edges of siding panels, the present invention also supports the siding panel while it is being installed. This support provides some assistance to the installation worker and enables an installation working to more quickly and accurately install siding panels on a structure.

10 Claims, 7 Drawing Sheets

SIDING INSTALLATION TOOL

CROSS REFERENCE TO RELATED APPLICATIONS

This application is related to and claims priority from provisional application No. 61/576,447 filed on Dec. 6, 2011, the contents of which are incorporated herein by reference.

FIELD OF THE INVENTION

This invention relates to a device for installing siding panels on a structure or building and in particular, this invention relates to a device that supports and balances a siding panel while a worker is installing the siding panel.

BACKGROUND OF THE INVENTION

Siding is the outer covering or cladding of a house meant to shed water and protect from the effects of weather. On a building that uses siding, it may act as a key element in the aesthetic beauty of the structure and directly influence its property value. Siding may be formed of horizontal or vertical boards, shingles, or sheet materials. In all four cases, avoiding wind and rain infiltration through the joints is a major challenge, met by overlapping, by covering or sealing the joint, or by creating an interlocking joint such, as a tongue-and-groove. Since building materials expand and contract with changing temperature and humidity, it is not practical to make rigid joints between the siding elements.

Siding may be made of wood, metal, plastic (vinyl), cement, or composite materials. It may be attached directly to the building structure (studs in the ease of wood construction), or to an intermediate layer of horizontal planks called sheathing.

In the housing industry, teams of two installers generally apply siding to a house or other building. This allows each member of the team to measure the proper overlap of siding and then attach the siding to the side of the home. Generally, the length of the siding prevents one person from performing the job alone. If one person could properly attach the siding, productivity would increase.

Many tools exist to assist persons in installing siding on houses. One such tool is described in U.S. Pat. No. 6,434,853. This tool is a siding application tool that includes an overlap portion having upper and lower ends, an L-shaped hook portion that forms a generally right-angle hook with the upper end of the overlap portion, an L-shaped retainer portion that forms a generally right-angle retainer with lire lower end of the overlap portion, and a plate member that extends from the L-shaped retainer portion that is generally perpendicular to the plane of the overlap portion. The L-shaped hook portion includes an upper bearing surface, and the L-shaped retainer portion includes a lower hearing surface. The upper and lower hearing surfaces are generally parallel with the plate member.

Another siding installation tool is described in U.S. Pat. No. 6,705,021. The tool includes a body having a handle said a pair of vertically spaced-apart seat assemblies that define a seat distance there between. The lower seat assembly is adapted to engage the lower portion of a previously installed siding piece, and the upper seat assembly is adapted to support the lower portion of a siding piece to be installed at the determined reveal distance relative to the previously installed siding piece. The reveal distance is at least substantially defined, by the seat distance. In some embodiments, the tool enables two or more installers to with one hand properly hold and provide for level alignment of the piece of lap siding to be installed, while at the same time enabling the installer's to mechanically fasten the same with the other hand. In some embodiments, the tool is adjustable to accommodate a range of reveal sizes.

A portion of a face 110 of a building is shown in FIG. 1 with lap siding installed thereupon. As shown, three pieces of lap siding am at least partially shown and generally indicated at 114, 116 and 118. Each piece of Ian siding includes a bottom edge, or downwardly oriented surface, 120 and a face 122. The faces 122 include an exposed portion 124 and an occluded portion 126, which is covered, or overlapped, by the piece of lap siding installed above it. It should be understood that the top-most piece of lap siding installed on face 110 may not have an occluded portion or that occluded portion 126 may be formed, by a piece of molding or trim, as opposed to another piece of lap siding. The distance between adjacent edges 120 is referred to as the "reveal" or "reveal distance" 128 of the lap siding and corresponds to the generally vertical length of the exposed portions 124 of the pieces of lap siding. The dimensions of the reveal, may vary, with four, five, six, seven and eight inch reveals being common. Typically, each piece of lap siding is at least four feet in length, and lap siding is often at least six, eight, ten, twelve or more feet in length. Lap siding may be formed of any suitable material, including wood, composites, metal, vinyl, and the like. It should be understood that the length, height, reveal, mid materials of construction of the lap siding may vary and that the scope of the present invention, should not be limited to a particular range of values for these variables. Instead, a lap siding tool constructed according to the present invention may be sized to accommodate any particular type of lap siding. Although several Cools are available to assist in the installation of siding, there remains a need for an improved siding installation tool that can measure the position of the siding arid can assist the worker in the installation of the siding.

SUMMARY OF THE INVENTION

The present invention comprises an improved panel siding installation device. The device enables a worker installing panel siding on a building structure such as a house to accurately and efficiently measure the distance between edges of adjacent siding panels. This distance is referred to as the "reveal" or "reveal distance" of the lap siding. The reveal distance corresponds to the generally vertical, length of the exposed portions of the pieces of lap siding. In addition to accurately measuring the distance between edges of siding panels, the present invention also supports the siding panel while it is being installed. This support provides some assistance to the installation worker and enables an installation working to more quickly and accurately install siding panels on a structure.

The siding installation device of the present invention comprises a bottom lip surface that engages an installed siding panel. A top surface positioned a determined distance from the bottom lip supports the siding panel that is being installed. This distance between the bottom lip and top support surface is the reveal distance or distance between the siding panel edges. In an embodiment of the present invention the distance between the top support and bottom lip can be adjusted to accommodate various sizes of siding panels.

DETAILED DESCRIPTION OF THE INVENTION

The present invention is an improved siding installation tool, to facilitate the efficient installation of siding on building structures. As previously mentioned, in the installation of siding, teams of two installers generally apply siding to a house or other building. This approach allows each member of the team to measure the proper overlap of siding and then attach the siding panels to the side of the home. Currently, an installer has to mark a location on an installed siding panel, then position the new panel that is to be installed at the mark. For accurate installation, the marks for both installers must be at the same level. This means each worker must measure the exact same distance for proper alignment of the siding panel to be installed. The workers must also measure level on the siding panel, after installation, in ensure that the siding panel, alignment is accurate. This process of marking the siding panel, positioning the new panel on the markings and then measuring fee level of the newly installed siding panel is very time-consuming and inefficient The present invention enables each siding installer to measure and position a new siding panel for installation without the need to mark an installed siding panel or measure the level of tire newly installed siding panel.

Figure 1:
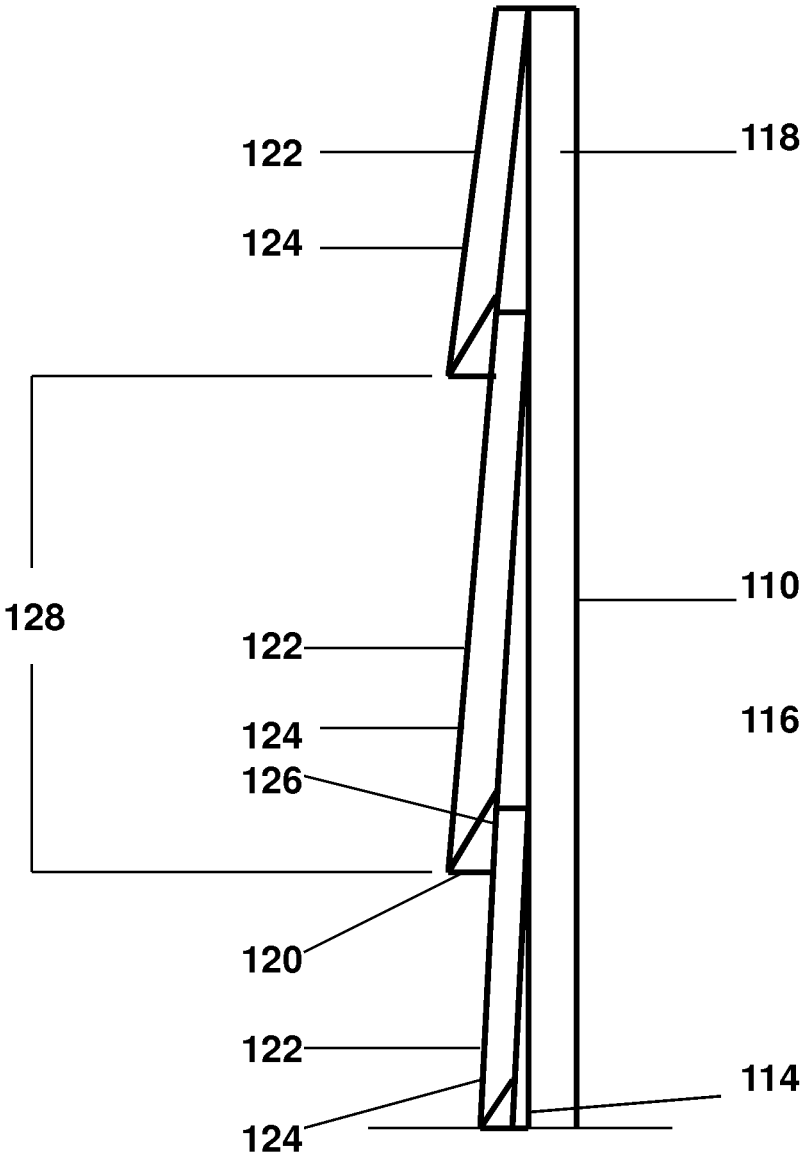
FIG. 1 Related Art
FIG. 1 is a view of siding panels installed on a housing wall.
Figure 2:
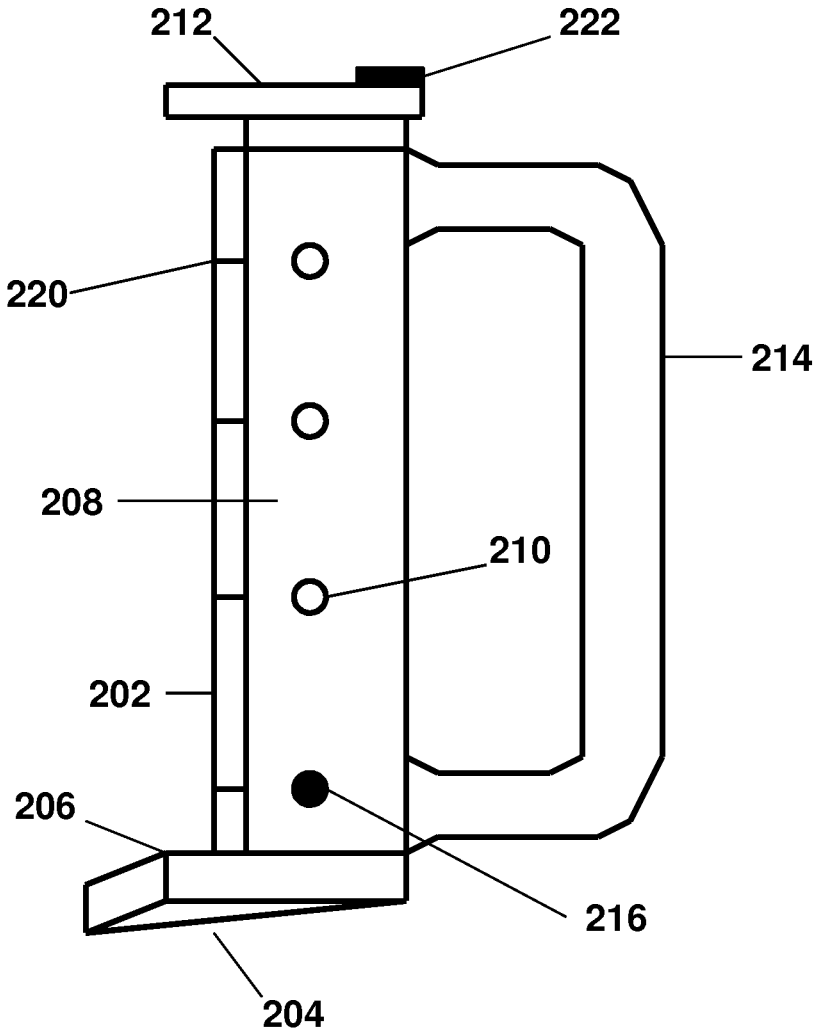
FIG. 2 is a view of an adjustable siding installation tool in accordance with an embodiment of the present invention m a dosed position.

FIG. 2 shows a preferred embodiment of the siding installation, tool of the present invention. This tool can indicate the position of a siding panel that is to be installed based on the position of an already Installed siding panel. As indicated in FIG. 1, an installed siding panel overlaps the siding panel directly beneath it. When a siding panel overlaps another siding panel, the exposed portion of the overlapped siding panel is used to determine the position of the siding panel to be installed. With the tool of the present invention, the installer is able to identify the location on the installed siding panel in order to position the new siding panel that will be installed.

The tool in FIG. 2 comprises a ruler element 202 to measure the distance from the bottom of an installed siding panel to the position for the bottom of the next siding panel to be installed ("fee revealed distance"). This element has a linear or straight rectangle shape and can have measurement markings 220 along its edge to indicate different distances. At the bottom of the ruler element is a base 204. This base has an extended, portion 206 with a flat surface that can engage the bottom edge of an installed siding panel. A handle 214 attaches to the ruler element to enable fee installer to hold and maneuver the installation tool. The handle can have a generally linear shape or it can contain recesses to accommodate the fingers of the worker. A handle with recesses for the worker's fingers will enable the worker to maintain a more secure grip of the handle. The ruler element 202 can have a hollow internal channel that holds a ruler extension component 208. This ruler extension component is slidably attached to the ruler dement 202 and can move linearly (usually vertically) in relation to the ruler element. The ruler extension component provides for the capability to adjust the length of the installation tool as needed for various sixes of siding panels. The ruler extension component 208 also has a locking pin 216 that can extend and engage various notch holes 216 of the ruler element to secure the rater extension at a desired distance. The locking pin can be a spring function such that the pin can be depressed while the ruler extension is being adjusted. Once the worker has reached the desired adjustment, the locking pin is aligned with the desire notch hole 210. The locking pin extends out through the notch hole to lock the ruler extension in position. The top of the ruler extension component comprises a lid extension 212 that extends outward from the ruler element in the same direction as the extended base portion 206. This top extension can also have a bat top surface that is capable of supporting a siding panel that is to be installed. The top lid extension can optionally have a rubber material 222 affixed to the surface to increase friction and more securely support the siding panel resting on the top lid. The top lid extension 212 and bottom extension 206 define the measurement of the exposed portion of the installed siding panel. In FIG. 2, the ruler extension locking pin engages the bottom notch hole 210. This position is considered the closed position of the installation tool as opposed to a position where the ruler extension 208 is extended upward and where the locking pin 216 of the ruler extension engages another notch hole 210 on the ruler element.

The siding installation tool of the present invention can be comprised of various materials. The materials can include rubber, plastic or metal. Because some of the embodiments of the present invention are mechanical In that a user has the ability to alter or adjust the reveal, distance of the siding tool, some materials may be suitable or preferable. For example, a tool comprised of an aluminum material may be more suitable for mechanical embodiments of the present invention.

Figure 3:
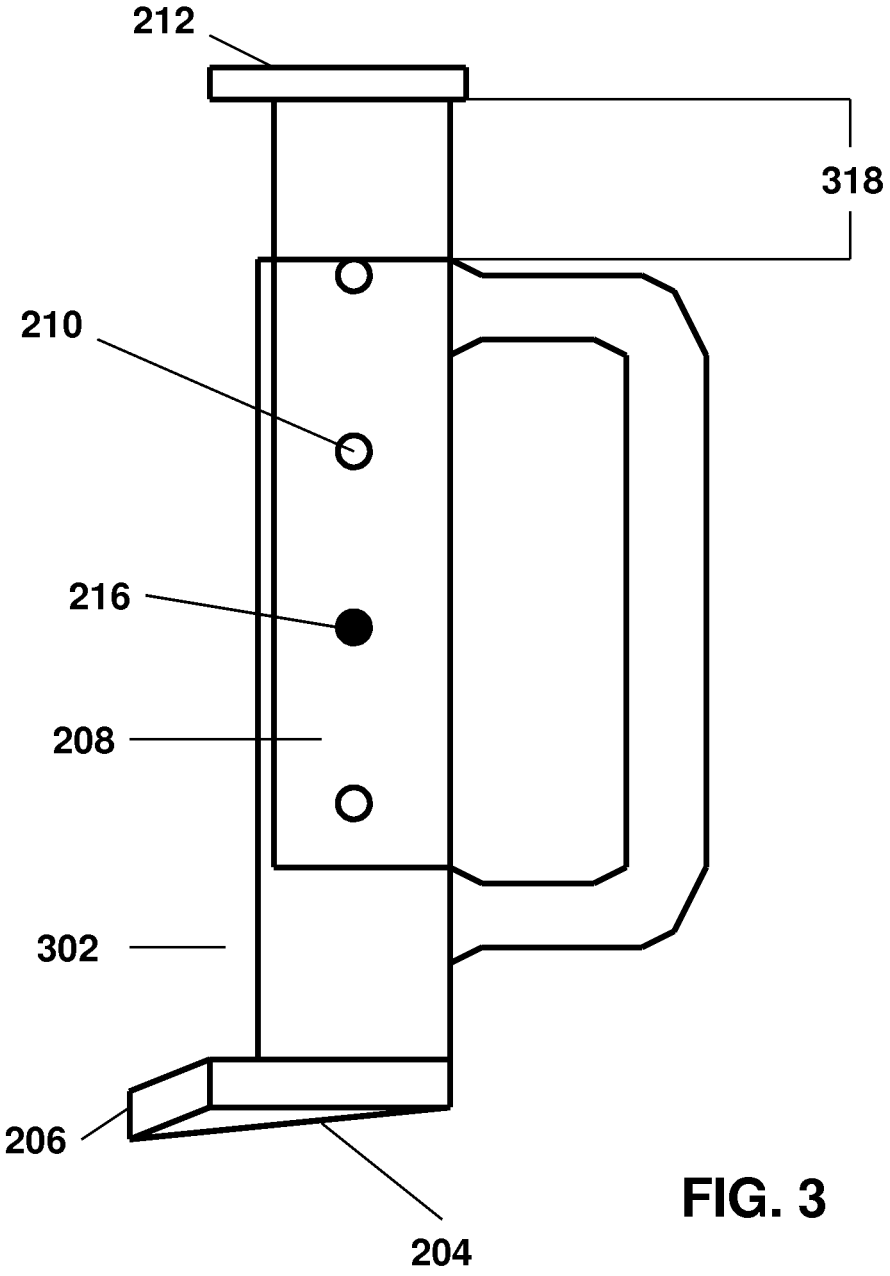
FIG. 3 is a view of the adjustable siding installation tool of FIG. 2 in an extended position.

Referring to FIG. 3, shown, is the siding installation tool of FIG. 2 adjusted to an extended position. As shown, the ruler extension 208 is extended upward such that the locking pin 216 engages the second notch hole upward. When the locking pin 216 engages the second notch hole upward, the installation is locked into place at the new position. The added length, of the installation tool resulting from the extension-is indicated by 318. With this adjustment, the lid 212 of the ruler extension 208 provides an indicator for a different height of siding panel from the illustration in FIG. 2. FIG. 3 also shows the top and bottom side of the base 204 of the bottom extension 206. As mentioned, this bottom lip will engage the bottom edge of the already installed siding panel. With the ability of the installer to adjust the distance between the bottom lip 206 and the top lid extension 212, the sliding installation tool of the present invention can accommodate various sizes of siding.

An alternate embodiment to the series of notch holes at discrete intervals is to have a groove that extends the length of the series of notch holes. Instead of inserting a pin into a notch hole, in this embodiment, a screw is inserted into the groove. The screw slides along the length of the groove and can be tightened at any desired length. With this embodiment, the user is not limited to specific measurement designations.

Figure 4:
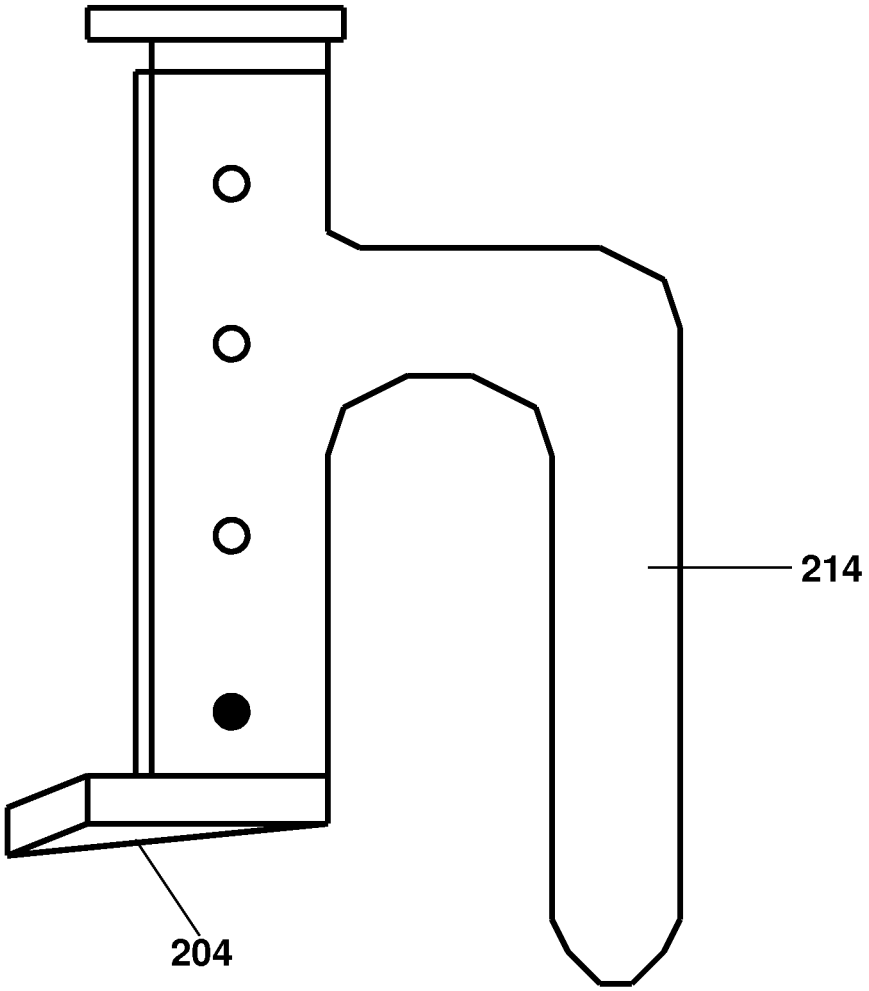
FIG. 4 is a view of an alternate embodiment of the adjustable siding installation tool of the present invention.

FIG. 4 is a view of an alternate embodiment of the adjustable siding installation tool of the present invention. In this embodiment, the handle element 214 has a different design.

The base of portion 204 of this design is substantially similar to the designs in FIGS. 2 and 3. In addition, the other features of the embodiment of FIG. 4 are the same as in FIGS. 2 and 3. This embodiment also has the same functionality and capabilities as the designs in FIGS. 2 and 3.

Figure 5:
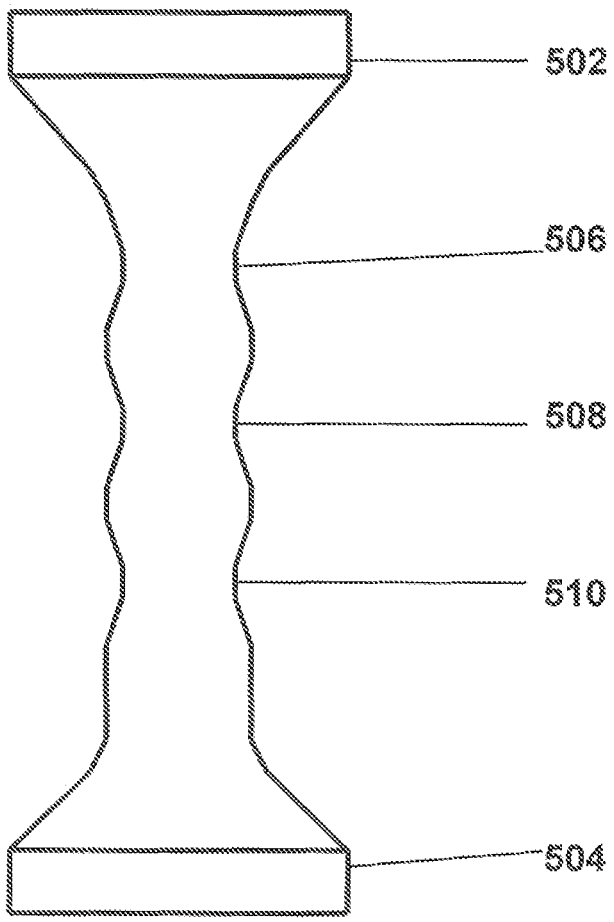
FIG. 5 is a view of a non-adjustable siding installation tool in accordance with an embodiment of the present invention.
Figure 6:
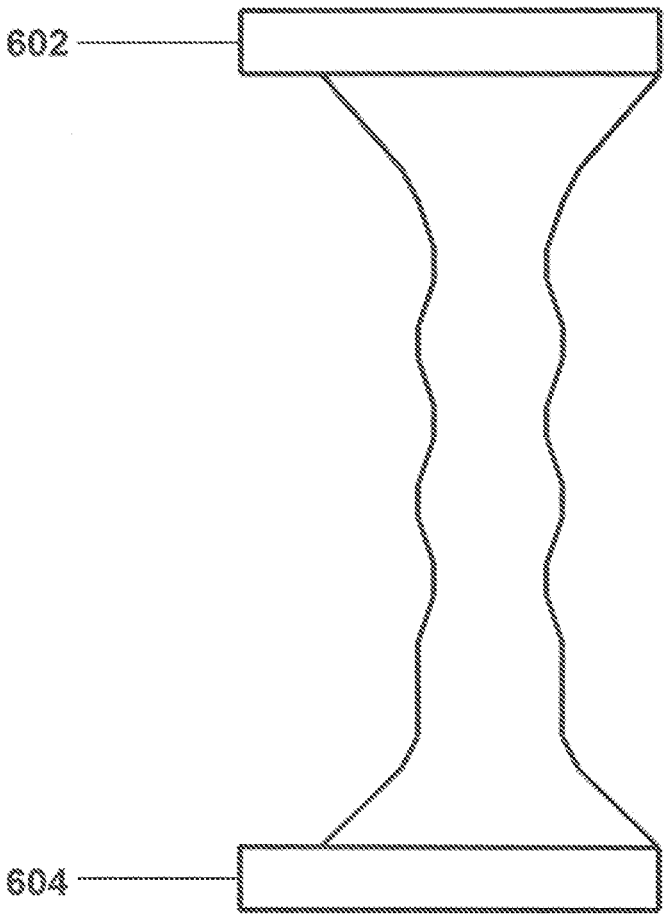
FIG. 6 is a side view of a non-adjustable siding installation tool in accordance with an embodiment of the present invention showing extension edges.

FIG. 5 shows a non-adjustable siding installation tool embodiment of the present Invention. This tool has top and bottom edges 502 and 504 and can have a symmetrical design. Grooves 506, 508 and 510 provide the means to better handle the tool. FIG. 6 gives a side view of this embodiment of the installation tool. This view shows extended top and bottom edges 602 and 604 that will engage the edges of the siding panels. Similar to the adjustable design, in operation, the bottom edge 504 of the tool engages the bottom edge of an installed siding panel. The top end/edge of the tool 502 indicates the position of the next siding panel to be installed. As with the adjustable design, the top edge 502 will also be able to support the siding panel during installation. In the implementation of the siding tool of the present invention, siding installers do not need to physically measure and mark the siding panels to determine the proper position of the siding panels during Installation.

Figure 7:
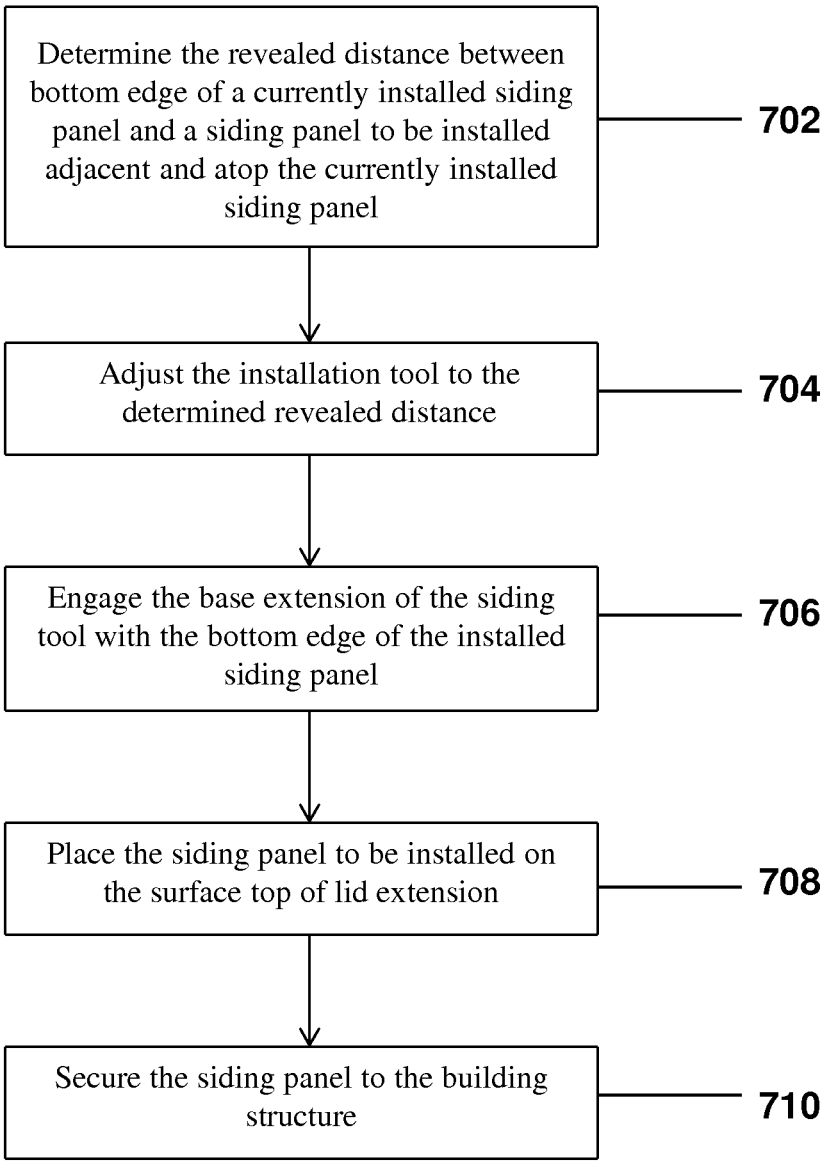
FIG. 7 is a flow diagram of the steps in the implementation of the siding Installation tool of the present invention.

FIG. 7 illustrates the steps in the implementation of the siding installation tool of the present invention. In operation, the present Invention is designed to measure the distance between adjacent bottom edges of the siding panels as shown in FIG. 1. The revealed edge of the siding panel 128 is this measured distance of the tool of the present invention. Referring to FIG. 2, this distance will be the distance between the extended portion 206 and the top lid 212. In the implementation of the tool of the present invention, in step 702, the installer determines the revealed distance between the previously installed siding panel and the next siding panel to be installed. After the installer determines this distance, in step 704, the installer will adjust the installation tool to the determined distance. In practice, depending on the determined measurement, the tool may already be at the determined distance, if adjustments to the installation tool are needed, the adjustments will be as previously described. Next, in step 706, the installer will position the base extension 206 of the installer tool against the bottom edge of the siding panel that is immediately such that the base extended portion 206 engages the bottom edge of the siding panel. In step 708, the installer then places a siding panel that is to be installed on the top surface of the top lid extension 212. At this point, the top lid 212 indicates the position for the next siding panel. The top lid 212 is designed such that the top lid has a surface area that can also support the siding panel to be installed. At this point, the new siding panel that is to be installed is resting on the installation tool of the present invention. With each installer having one of the present installation tools, in step 710, the siding panel is secured to the building structure. Installers can use tools such as nail guns and staplers to secure the siding panel. With the siding panel installed, the installers repeat the installation method of the present invention.

This invention provides significant advantages over the current art. The invention has been described in connection with its preferred embodiments. However, it is not limited thereto. Changes, variations and modifications to the basic design may be made without departing from the inventive concepts in this invention, in addition, these changes, variations and modifications would be obvious to those skilled in the art having the benefit of the foregoing teachings. All such changes, variations and modifications are intended to be within the scope of this invention.

I claim:

1. An improved siding installation tool comprising:

a generally linear device comprising a linear body section of the siding installation tool;

a base section formed at a lower end of said linear body section, said base section, having a lip-type extension extending from, said linear body section for engaging a siding panel currently installed on a building structure;

a top section formed at a top end of said linear body section, said top section having a flat surface and at least a portion of said top section, extending outward from said body section in the same manner and direction as said base section; and a ruler element to measure distance from an installed siding panel bottom edge to the position for a bottom edge of a next siding panel to be installed, said ruler element having a hollow internal channel that holds said ruler extension component, the ruler extension component being attached to said top section and being slidably attached to the ruler element and being capable of moving linearly in relation to said ruler element the ruler extension providing the capability to adjust a length of the siding installation tool as needed for various sizes of siding panels.

2. The improved siding installation, tool as described in claim 1, wherein said body section contains measurement markings and wherein said body section is used as a handle.

3. The improved siding installation tool as described in claim 1 wherein said top section further comprises a rubber material, affixed to said top section to increase friction and further secure a siding panel positioned on said top section.

4. The improved siding installation tool as described in claim 1 wherein said linear body section can be used as a handle for holding the improved siding installation tool.

5. An improved siding installation tool comprising:

a generally linear ruler element to measure distance from an installed siding panel bottom edge to the position for a bottom edge of a next siding panel to be installed, said ruler element having a hollow internal channel that holds a ruler extension component, the ruler extension being slidably attached to the ruler element and being capable of moving linearly in relation to said ruler element, the ruler extension further having adjustment notch holes for providing the capability to adjust a length of the siding installation tool as needed for various sixes of siding panels;

a base section formed at a lower end of said linear ruler element, said base section having a lip-type extension extending from said linear ruler element for engaging a siding panel currently installed on a building structure;

a top section formed at a top end of said linear ruler element, said top section having a fiat surface and at least a portion of said top section extending outward from said linear ruler element in the same manner and direction as said base section; and handle element attached to said linear ruler element for holding and positioning said linear element during a siding installation.

6. The Improved siding installation tool as described in claim 5 further comprising a locking pin that is spring attached to and extends outward from said ruler extension component.

7. The improved siding installation tool as described in claim 5 wherein said linear rule element contains measurement markings and wherein said body section is used as a handle.

8. The improved siding installation tool as described in claim 5 wherein said top section further comprises a rubber material affixed to said top section to increase friction and further secure a siding panel positioned on said top section.

9. The improved siding installation tool as described in claim 5 wherein said handle element is attached to said linear ruler element at two different contact points.

10. The improved siding installation tool as described in claim 5 wherein said handle element is attached to said linear rider element at one point.

* * * * *